United States Patent [19]

Joyce

[11] 4,014,490

[45] Mar. 29, 1977

[54] APPARATUS FOR FEEDING AND APPLYING FEATURES TO CONTINUOUS WEBS OR ITEMS THEREON

[75] Inventor: Donald James Joyce, London, England

[73] Assignee: Consort Project Development Limited, London, England

[22] Filed: Jan. 2, 1975

[21] Appl. No.: 537,866

[30] Foreign Application Priority Data

Jan. 3, 1974 United Kingdom ..... 00257/74

[52] U.S. Cl. ..... 226/76; 226/141; 226/156; 226/188

[51] Int. Cl.[2] ..... B65H 17/22

[58] Field of Search ..... 226/148, 156, 157, 139, 226/141, 76; 192/70.15, 70.14, 48.6, 12 B; 83/620, 700

[56] References Cited

UNITED STATES PATENTS

| | | | |
|---|---|---|---|
| 819,277 | 5/1906 | Holman | 192/12 B |
| 2,245,017 | 6/1941 | Sinclair | 192/48.6 X |
| 2,930,271 | 3/1960 | Whistler | 83/700 X |
| 3,369,449 | 2/1968 | Klauss | 226/141 X |
| 3,524,370 | 8/1970 | Thompson | 83/620 X |
| 3,669,327 | 6/1972 | Dowd | 226/74 |
| 3,737,089 | 6/1973 | Slavic | 226/156 |
| 3,753,522 | 8/1973 | Voges | 226/141 |

*Primary Examiner*—Richard A. Schacher
*Attorney, Agent, or Firm*—Lowe, King, Price & Markva

[57] ABSTRACT

Apparatus for feeding continuous stationery or other web material or items thereon to be processed comprises a machine bed, drive means for feeding the web material over the machine bed and a framework adapted for mounting at least one of a range of units above the machine bed whereby a variation of processing steps may be carried out on the web material or said items. The web material may be driven over the machine bed intermittently to provide at least one moving period during which the web material or at least one of the items thereon may be processed by a printing unit, and at least one dwell period during which the web material or at least one of the items thereon may be processed by a numbering unit and/or a punching unit.

11 Claims, 3 Drawing Figures

APPARATUS FOR FEEDING AND APPLYING FEATURES TO CONTINUOUS WEBS OR ITEMS THEREON

BACKGROUND OF THE INVENTION

1. Field of the Invention

This invention relates to apparatus for feeding and applying features to continuous webs, e.g. continuous stationery, reels of paper and other materials or items thereon.

2. Prior Art

Many types of machines are known for processing continuous stationery, for example printing, numbering, punching etc., in which the continuous stationery is fed through the machine and a processing step is carried out either while the continuous stationery is moving or during a dwell period. However, all such machines are designed to carry out only one particular processing step or a predetermined set of processing steps.

SUMMARY

According to the invention there is provided apparatus for feeding continuous stationery or other web material or items thereon to be processed, the apparatus comprising a machine bed, drive means for feeding the web material over the machine bed either continuously or intermittently, and a framework adapted for mounting one or more of a range of units above the machine bed whereby a variation of processing steps may be carried out on the web material or said items.

Preferably the drive means include at least one continuously driven outlet to which may be coupled the or one of said units, e.g. a printing unit, for processing the web material or one or more of said items while the web material is being fed over the machine bed.

It is also preferred that the drive means include a clutch for disconnecting the drive to the web material to provide a dwell period during which at least one processing unit, e.g. a numbering unit or a punching unit, may be operated while the web material is stationary.

Preferably means are provided for operating the clutch at regular intervals to provide an operating cycle including at least one moving period and at least one dwell period, whereby one or more selected processing steps may be carried out on the web material or one or more of said items during each operating cycle. The operating cycle is preferably variable at will to suit the desired processing steps.

The apparatus may be provided with a feed inlet and a feed outlet for the web material. Alternatively, and/or additionally, the apparatus may be coupled to other apparatus for carrying out preliminary and/or additional processing steps on the web material or items thereon.

The invention also includes feeding apparatus as described above in combination with one or more processing units mounted on the framework above the machine bed.

DESCRIPTION OF THE PREFERRED EMBODIMENT

Figure 1:
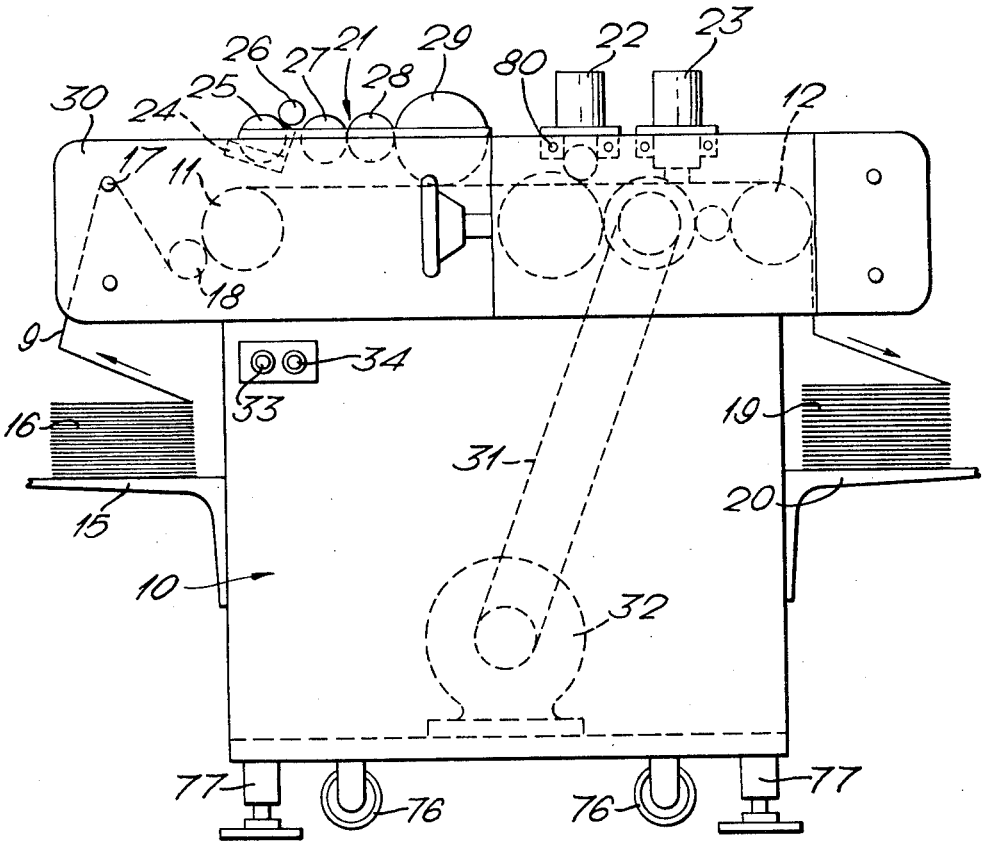
FIG. 1 is an elevation, by way of example, of apparatus for feeding and processing continuous stationery.

Referring to the drawings, apparatus for feeding and processing continuous stationery 9 comprises a framework 10 providing a machine bed intermediate inlet and outlet rolls 11, 12. In this embodiment, the outlet roll 12 comprises a pair of spaced apart pin-wheels 13 for engaging marginal holes in the continuous stationery, which pin-wheels are keyed to a shaft 14. Below the inlet roll 11 is a shelf 15 to support a stack 16 of folded continuous stationery which is drawn around guide rollers 17, 18 over the inlet roll 11, the machine bed and the pin-wheels 13, and then formed into another stack 19 on a shelf 20.

In other embodiments the continuous stationery may start and finish in a roll or may be supplied from and fed to other apparatus, as desired.

However, in each case, the continuous stationery is passed in a flat, opened-out state over the machine bed whereby one or more processing steps may be carried out on the continuous stationery. In this embodiment, there are provided above the machine bed a printing unit 21, a numbering unit 22, and a punching unit 23 for repeatedly processing the continuous stationery 9 during successive operating cycles, the printing unit operating during a moving period and the numbering and punching units operating during a subsequent dwell period of each operating cycle. The printing unit 21 is conventional and comprises an ink tray 24, ink transfer rollers 25, 26, an oscillating roller 27, a form roller 28, a letterpress cylinder 29, and an impression cylinder (not shown) mounted beneath the machine bed and below the letterpress cylinder. The numbering and punching units 22 and 23 are similarly conventional units. However, in accordance with this invention, each unit is readily replaceable by other units as may be desired, and also the exact position of both the numbering and punching units is readily adjustable both transversely and longitudinally of the machine bed. For this purpose, the numbering and punching units are mounted on bars 80 extending between the side walls 30 of the framework of the apparatus. The desired relationship of the numbering and punching units with respect to each other and with respect to the letterpress cylinder 29 is thus adjustable at will. Similarly, the relationship of the letterpress cylinder with respect to the pin-wheels 13 may be varied by adjusting the positions of the pin-wheels along the shaft 14 or by adjusting the initial rotary position of the shaft 14 by means described below.

To drive the printing unit 21 and the pin-wheels 13, there is provided drive means operated by a double belt drive 31 from a variable speed DC electric motor 32 controlled by start and stop buttons 33, 34. The belt drive 31 rotates a shaft 35 on which is mounted a gear wheel 36 for driving both a gear wheel 37 mounted on a shaft 38 and a gear train 39 connected to the pin-wheel shaft 14. Mounted on the shaft 38 is a gear wheel 40 to which is coupled the printing unit 21, and the shaft 38 may be rotated manually by a hand wheel 43 by means of bevel gears 41, 42. The bevel gear 41 attached to the hand wheel 43 is spring urged out of engagement with the bevel gear 42 mounted on the shaft 38. The hand wheel 43 can alternatively be mounted on any convenient shaft and coupled to the bevel gear 42 by a one-way clutch-type bearing.

The gear train 39 comprises a double gear wheel 44 mounted on a shaft 45 and a gear wheel 46 freely rotatable on a shaft 47 and held thereon by a circlip 48. The drive from the gear wheel 46 is transmitted through a toothed hub 49 on the gear wheel 46 to a correspondingly toothed clutch member 50 keyed to a shaft 51 connected by a coupling 52 to the pin-wheel shaft 14. It is this coupling 52 which allows limited rotary adjustment between the shafts 51 and 14.

Figure 2:
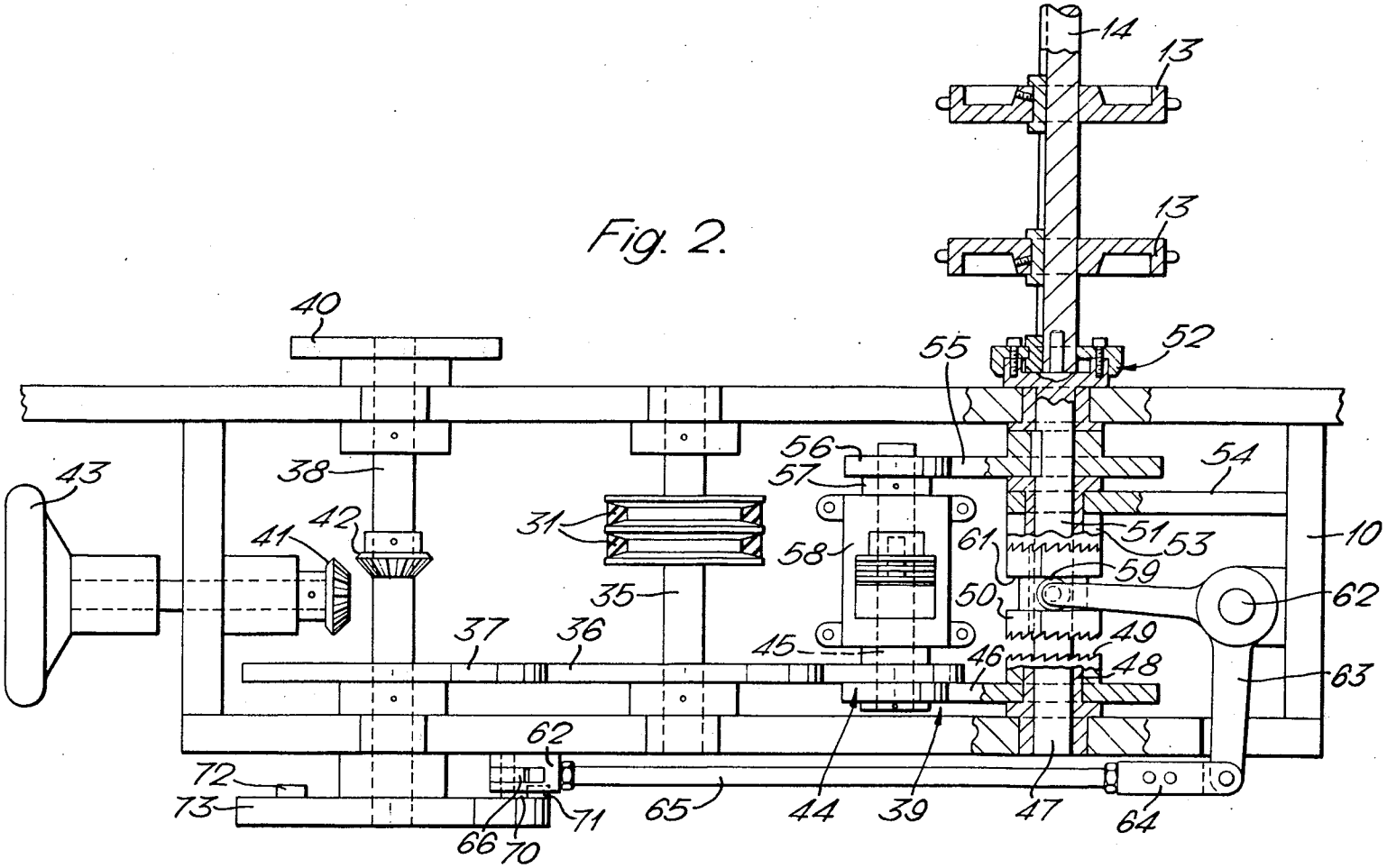
FIG. 2 is a plan view of the drive and variable indexing means for the apparatus shown in FIG. 1.

The toothed clutch member 50 may be moved longitudinally along the shaft 51 for engagement of the above-mentioned teeth with the toothed hub 49 of the gear wheel 46 and thereby connection of the drive to the pin-wheel shaft 14, or for engagement (as shown in FIG. 2) of further teeth with a further toothed member 53 held stationary by a bar 54 to the framework 10 of the apparatus and thereby disconnection of the drive to the pin-wheel shaft 14.

In order to provide accurate positioning of the continuous stationery 9 for processing by the numbering and punching units 22, 23 during the dwell period of the operating cycle, it is desirable that the continuous stationery should be stopped both positively and immediately. To this end, a gear wheel 55 is keyed to the shaft 51 intermediate the fixed toothed member 53 and the coupling 52. This gear wheel 55 engages a gear wheel 56 mounted on a shaft 57 which is coaxial with the shaft 45 and connected thereto by a clutch 58 which in this embodiment is an electro-magnetic clutch, but which may be a spring loaded or similar friction device.

On disconnection of the drive to the pin-wheel shaft 14 by sliding the toothed clutch member 50 towards the fixed toothed member 53, the clutch 58 is operated to effect a slipping drive between the gear train 39 and the gear wheels 56, 55. However, the gear wheels 56, 55 are not able to rotate since the shaft 51 is held against rotation by engagement of the member 53 with the toothed clutch member 50; but the direct drive attempting to rotate the gear wheel 55 effectively urges the member 53 into firm engagement with the toothed clutch member 50 and results in the accurate stopping position of the pin-wheels 13 and thereby the continuous stationery. For sliding the toothed clutch member 50 longitudinally of the shaft 51, there is provided a roller 59 carried by a lever 60, which roller engages a peripheral groove 61 in the toothed clutch member 50. The lever 60 is mounted on the lower end of a vertical shaft 62 which carries, at its upper end, a second lever 63. The free end of the lever 63 is connected to a clevis 64 at one end of a link 65. The other end of the link 65 is connected by another clevis 68 to a further lever 66 pivotally mounted on a pin 67 attached to the framework of the apparatus. Pivotal movement of the lever 66 will thereby rotate the shaft 62 and cause the roller 59 to slide the toothed clutch member 50 in one direction or the other along the shaft 51. A spring-engaged detent 69 is provided to determine the two extreme positions of the link 65 when the toothed clutch member 50 is engaged with the toothed hub 49 or the fixed toothed member 53.

Figure 3:
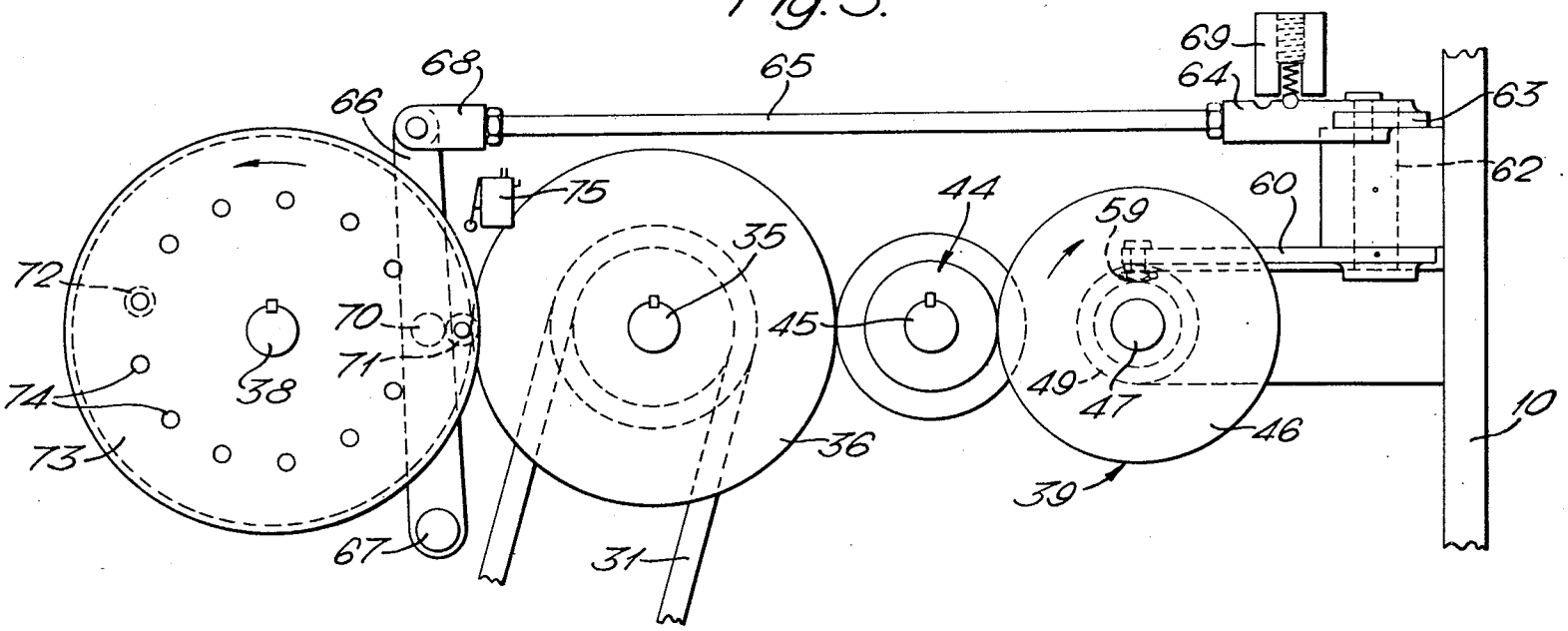
FIG. 3 is an elevation of part of the drive and variable indexing means.

The lever 66 carries a projection 70 for successive engagement with, in this embodiment, two pins 71, 72 carried by an indexing disc 73 mounted on the shaft 38. In the position shown in FIG. 3, the pin 71 has engaged the right-hand side of the projection 70 and has disconnected the toothed clutch member 50. However, although the continuous stationery 9 has now been stopped, the drive continues to rotate the disc 73 in an anti-clockwise direction as shown in FIG. 3 until the pin 72 engages the left-hand side of the projection 70. This action will pivot the lever 66 in a clockwise direction and so reengage the toothed clutch member 50. The continuous stationery will then move forward until it is stopped again by a further disconnection of the toothed clutch member. Thus, in this embodiment, each operating cycle contains one moving period and one dwell period. In an alternative embodiment, a similar operating cycle is achieved by reversing the positions of the drive engagement pin 72 and the drive disengagement pin 71, i.e. by repositioning the pin on the disc 73 at the radius of the pin 71 and vice versa, the teeth on the toothed clutch assembly 49, 50, 51 also being at the opposite hand to that shown.

To allow for variation of the lengths of the moving and dwell periods within one revolution of the disc 73, the pin 72 is attached to the disc 73 at any one of twelve holes 74. Further variation may be accomplished by providing another disc having a different arrangement of holes for the pin 72. Moreover, two or more moving periods and two or more dwell periods may be achieved in each operating cycle by providing a different indexing disc having a second hole for a second pin 71 circumferentially spaced from the first pin 71 and by employing two pins 72 again circumferentially spaced apart.

The versatility of the variation possibilities can be even further enhanced by providing other discs together with other toothed clutch assemblies the teeth of which are suitably divided to coincide with the holes in a new disc 73. The machine is specifically designed to provide for the direct interchange of different toothed clutch assemblies.

An electric circuit (not shown) for operating the numbering and punching units 22, 23 and the electromagnetic clutch 58 during the single dwell period of this embodiment is controlled by a micro-switch 75 which is normally open (as shown in FIG. 3) but which is closed by pivotal movement of the lever 66 to operate the toothed clutch member 50 to connect the drive to the pin-wheel shaft 14.

In operation of the apparatus, the leadind end of the continuous stationery is fed over the machine bed and the pin-wheels 13. The desired positional relationships of the printing, numbering and punching units 21, 22, 23 both with respect to each other and the continuous stationery are then made. The respective lengths of the moving and dwell periods of each operating cycle are selected by choosing the desired hole 74 for the pin 72.

The apparatus is then set and the motor 32 is switched on. The continuous stationery will then be fed intermittently to form the stack 19 of processed stationery on the shelf 20, a continuously rotating feature printing being carried out on the stationery during the moving period of each operating cycle and both a vertically reciprocating numbering feature and a vertically reciprocating punching feature being carried out on the stationery during the dwell period of each operating cycle.

Operational units applying features of any kind can be used mounted on the machine or 'in-line' or other production association with the machine. The means of motivation of such units may be mechanical, electrical or electro-mechanical, hydraulic, pneumatic or vacuum operated or caused to be operated by any other means. The units may be designed and used as may be appropriate for continuously rotating or intermittenly rotating and reciprocating applications—according to the need.

The versatility of the apparatus described above will be readily appreciated. The apparatus is not restricted to any one particular length or type of operating cycle. The length and number of the moving and dwell periods are readily and quickly adjustable by the selection of the required indexing disc 73 and the positioning and number of the pins 71, 72 together with the appropriate interchangeable toothed clutch assembly as may be required.

Indeed continuous running of the stationery 9 over the machine bed may be achieved by removing the pin 71 from the disc 73. Different units may readily be mounted above the machine bed, as desired, and if a second unit is required to be operated during the moving period, then the drive means is provided with another outlet drive similar to the gear wheel 40. The positioning and timing of each unit is readily adjustable.

A further important advantage of the apparatus described above is the provision of the clutch 58 or equivalent device which effects a positive and immediate stopping of the continuous stationery. To ensure the accuracy factor at this point the intermittent feed shafts are fitted with one-way clutch-type bearings. This is very desirable to provide for accurate operation of the unit or units to be used during the dwell period or periods, and also for accurate operation of the unit or units to be used during the following moving period.

Although the apparatus has been described above in connection with the processing of continuous stationery, it is, of course, applicable to the processing of other web material, for example lengths of cloth or metal.

It is also emphasised that the apparatus may be used for batch processing continuous stationery or in a line of machines as part of a continuous process.

The infeeding, outfeed and web-tension factors can be varied to suit the operational requirement in accordance with the material being processed and the tension conditions requisite for good feeding and accurate registration. The pinwheels already described may be replaced by pin-feeding tractors or other similar devices with suitably placed feed projections at outfeed and/or infeed locations. The pinfeeds may be replaced by nip-friction feeding roller devices at outfeed and/or infeed locations. Pinfeed and friction feed devices may be used together in a combined infeed/outfeed operation. Web-tension requirements may be controlled by the application of one or more brushes to provide back-tension in association with the outfeed, and/or brushes or other friction application devices may be used to provide the desired result at any point or points throughout the web-path.

The machine may be fitted with a conveyor belt which is motivated by the infeed and/or outfeed shafts for operations other than web-fed on materials or items. The belt can receive individual items which could be accurately positioned on the belt by suitable locating attachments operating in association with the feeding mechanism. Features and handling operations could be accurately applied to each item on the belt by appropriate units mounted on or otherwise used with the machine. For example, transistor modules receive accurate spots of solder or various additional components fed from units mounted on the machine. The conveyor belt could be modified to accommodate a variety of different items as may be needed from time to time.

Furthermore, in keeping with the complete versatility of the apparatus, the framework 10 of the apparatus described above is mounted on castors 76 with additional semi-permanent legs 77 which may be screwed up to allow the apparatus to be moved on the castors. The screw legs 77 are also useful to allow for uneven floor surfaces.

I claim:

1. Apparatus for feeding continuous web material or items thereon to be processed, the apparatus comprising:

a. a machine bed, b. drive means for feeding the web material over the machine bed, c. a framework adapted for mounting at least one of a range of units above the machine bed whereby a variation of processing steps may be carried out on the web material or said items, d. said drive means including a clutch for disconnecting the drive to the web material to provide a dwell period during which at least one processing unit may be operated while the web material is stationary, e. means variable at will for operating the clutch at regular intervals to provide an operating cycle including at least one moving period and at least one dwell period, f. whereby at least one selected processing step may be carried out on the web material or at least one of said items during each operating cycle, g. said variable operating means comprising a disc which is rotatable by said drive means and carries at least one pair of projections spaced apart circumferentially on the disc for engagement in turn with a stationary member, and h. means responsive to each said engagement to effect operation of the clutch.

2. Apparatus as claimed in claim 1, wherein the drive means include at least one continuously driven outlet to which may be coupled said one unit for processing the web material or at least one of said items while the web material is being fed over the machine bed.

3. Apparatus as claimed in claim 1, including a feed inlet and a feed outlet for the material.

4. Apparatus as claimed in claim 3, wherein the web material has successive, evenly-spaced holes along each margin of the web material, and the feed outlet comprises a pair of pin-wheels spaced apart transversely of the web material for engaging the marginal holes in the web material.

5. Apparatus as claimed in claim 1, in combination with at least one processing unit mounted on the framework above the machine bed.

6. Apparatus as claimed in claim 1, wherein said means responsive to each said engagement is a mechanical linkage.

7. Apparatus for feeding continuous web material or items thereon to be processed, the apparatus comprising:

a. a machine bed, b. drive means for feeding the web material over the machine bed, c. a framework adapted for mounting at least one of a range of units above a machine bed whereby a variation of processing steps may be carried out on the web material or said items, d. said drive means including a clutch for disconnecting the drive to the web material to provide a dwell period during which at least one processing unit may be operated while the web material is stationary, e. said clutch including a sleeve having two sets of teeth, f. said sleeve being mounted for movement between a first position in which one of said sets of teeth engages corresponding teeth on the member connected to said drive means thereby transmitting the drive to the web material and a second position in which the other set of teeth engage further teeth on a fixedly disposed member thereby disconnecting the drive to the web material, g. means for operating the clutch at regular intervals to provide an operating cycle including at least one moving period and at least one dwell period whereby at least one selected processing step may be carried out on the web material or at least one of said items during each operating cycle, h. said operating means being variable at will and comprising a disc which is rotatable by said drive means, i. said disc carrying at least one pair of projections spaced apart circumferentially on the disc for engagement in turn with a stationary member, and j. means responsive to each said engagement to effect operation of said clutch.

8. Apparatus as claimed in claim 7, wherein said means responsive to each said engagement comprises a mechanical linkage.

9. Apparatus for feeding continuous web material or items thereon to be processed, the apparatus comprising:

a. a machine bed, b. drive means for feeding the web material over the machine bed, c. a framework adapted for mounting at least one of a range of units above a machine bed whereby a variation of processing steps may be carried out on the web material or said items, d. said drive means including a clutch for disconnecting the drive to the web material to provide a dwell period during which at least one processing unit may be operated while the web material is stationary, e. said clutch including a sleeve having two sets of teeth, f. said sleeve being mounted for movement between a first position in which one of said sets of teeth engages corresponding teeth on a member connected to said drive means thereby transmitting the drive to the web material and a second position in which the other set of teeth engages further teeth on a fixedly disposed member thereby disconnecting the drive to the web material, and g. means for effecting movement of said sleeve between said first position and said second position.

10. Apparatus as claimed in claim 9 wherein the sleeve has one set of teeth at each end and is mounted for sliding movement between its said first position and second position.

11. Apparatus as claimed in claim 9, including means for operating the clutch at regular intervals to provide an operating cycle including at least one moving period and at least one dwell period whereby at least one selected processing step may be carried out on the web material or at least one of said items during each operating cycle.

* * * * *